US010132208B2

(12) United States Patent
Nielsen

(10) Patent No.: US 10,132,208 B2
(45) Date of Patent: Nov. 20, 2018

(54) ENGINE VALVE LIFTER OIL FLOW CONTROL AND ANTI-ROTATION FEATURE

(71) Applicant: Eaton Corporation, Cleveland, OH (US)

(72) Inventor: Douglas J. Nielsen, Marshall, MI (US)

(73) Assignee: Eaton Corporation, Cleveland, OH (US)

( * ) Notice: Subject to any disclaimer, the term of this patent is extended or adjusted under 35 U.S.C. 154(b) by 118 days.

(21) Appl. No.: 15/206,708

(22) Filed: Jul. 11, 2016

(65) Prior Publication Data

US 2016/0319708 A1 Nov. 3, 2016

Related U.S. Application Data

(63) Continuation of application No. PCT/US2015/010729, filed on Jan. 9, 2015.
(Continued)

(51) Int. Cl.
*F01L 1/14* (2006.01)
*F01L 1/25* (2006.01)
*F01L 1/24* (2006.01)

(52) U.S. Cl.
CPC ..... *F01L 1/25* (2013.01); *F01L 1/14* (2013.01); *F01L 1/146* (2013.01);
(Continued)

(58) Field of Classification Search
CPC ..... F01L 1/14; F01L 1/25; F01L 1/146; F01L 2001/2427; F01L 2105/00
(Continued)

(56) References Cited

U.S. PATENT DOCUMENTS 4,607,599 A 8/1986 Buente et al.
7,458,352 B2 12/2008 Sailer et al.
(Continued)

FOREIGN PATENT DOCUMENTS

DE 3300032 A1 7/1984
DE 102011003902 A1 8/2012
JP 2004052605 A 2/2004

OTHER PUBLICATIONS

International Search Report and Written Opinion for International Application No. PCT/US2015/010729 dated Apr. 13, 2015, 16 pages.
(Continued)

*Primary Examiner* — Ching Chang
(74) *Attorney, Agent, or Firm* — RMCK Law Group PLC

(57) ABSTRACT

An engine roller lifter for use in a valve train of an internal combustion engine and constructed in accordance to another example of the present disclosure includes a body having an outer peripheral surface configured for sliding movement in a bore provided in the engine. The bore is supplied by an oil passage communicating therewith. The body can define a transverse passage. A groove can be formed around the body and inset from the outer peripheral surface. A connecting channel can be formed in the body and inset from the outer peripheral surface, the connecting channel fluidly connects the groove and the transverse passage. A roller bearing can be rotatably mounted to the body and configured for rolling contact with an engine camshaft. Oil received at the groove from the bore flows along the connecting channel, into the transverse passage and onto the roller bearing.

19 Claims, 6 Drawing Sheets

Related U.S. Application Data

(60) Provisional application No. 61/926,379, filed on Jan. 12, 2014, provisional application No. 62/101,162, filed on Jan. 8, 2015.

(52) U.S. Cl.
CPC ..... *F01L 2001/2427* (2013.01); *F01L 2001/2444* (2013.01); *F01L 2105/00* (2013.01)

(58) Field of Classification Search
USPC ..... 123/90.39, 90.52, 90.55, 90.48, 90.5
See application file for complete search history.

(56) References Cited

U.S. PATENT DOCUMENTS

| | | | | |
|---|---|---|---|---|
| 8,826,874 | B2 * | 9/2014 | Hattiangadi | F01L 1/146 123/90.5 |
| 2001/0004886 | A1 | 6/2001 | Brothers | |
| 2006/0005797 | A1 | 1/2006 | Schubeck | |
| 2010/0294219 | A1 | 11/2010 | Prokop | |
| 2012/0160195 | A1 | 6/2012 | Hattiangadi et al. | |

OTHER PUBLICATIONS

European Search Report for EP Application No. 15734839.2 dated Oct. 13, 2017, 7 pages.

* cited by examiner

ENGINE VALVE LIFTER OIL FLOW CONTROL AND ANTI-ROTATION FEATURE

CROSS-REFERENCE TO RELATED APPLICATIONS

This application is a continuation of International Application No. PCT/US2015/010729 filed Jan. 9, 2015, which claims the benefit of U.S. Patent Application No. 61/926,379 filed on Jan. 12, 2014 and U.S. Patent Application No. 62/101,162 filed on Jan. 8, 2015. The disclosures of the above applications are incorporated herein by reference.

FIELD

The present disclosure relates generally to hydraulic lash adjusting tappets of the type having a roller follower for contacting a cam shaft in an internal combustion engine valve train.

BACKGROUND

Roller lifters can be used in an engine valvetrain to reduce friction and as a result provide increased fuel economy. In other advantages, a roller lifter can open a valve quicker and for a longer period of time than a flat tappet lifter. In this regard, airflow can be attained quicker and longer increasing the ability to create power.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

An engine roller lifter for use in a valve train of an internal combustion engine and constructed in accordance to one example of the present disclosure includes a body having an outer peripheral surface configured for sliding movement in a bore provided in the engine. The bore can be supplied by an oil passage communicating therewith. The body can define (i) an axial pocket that receives a plunger therein and (ii) a transverse passage. A groove can be formed in the body and inset from the outer peripheral surface. A connecting channel can be formed in the body and inset from the outer peripheral surface, the connecting channel fluidly connecting the groove and the transverse passage. An anti-rotation ring can be received at the groove. A roller bearing can be rotatably mounted to the body and configured for rolling contact with an engine camshaft. Oil received at the groove from the bore flows around the anti-rotation ring, along the connecting channel and into the transverse passage and onto the roller bearing.

According to additional features, the groove has a first height in an axial direction. The anti-rotation ring has a second height in the axial direction. The first height is greater than the second height. The connecting channel can be transverse to an axis of the transverse passage. The transverse passage can extend entirely through the body. The body can further define an inset formed in the outer peripheral surface. The engine roller can further comprise an oil inlet hole defined in the body that connects the inset with the axial pocket. The oil inlet hole can be configured to communicate oil between the outer peripheral surface and the plunger.

According to still other features, the anti-rotation ring can be snap fit onto the groove of the body. The anti-rotation ring can include a ring body having an anti-rotation protrusion extending therefrom. The second height is defined at the ring body. The anti-rotation protrusion has a third height in the axial direction. The third height is greater than the second height. The anti-rotation protrusion can be configured to create a line contact with an opposing surface of a bore slot defined in the engine bore.

According to other features, the groove extends along a groove depth into the peripheral surface. The connecting channel can extend along a connecting channel depth into the peripheral surface. The groove depth can be greater than the connecting channel depth. The connecting channel can extend axially along the peripheral surface in a direction transverse to the transverse passage.

An engine roller lifter for use in a valve train of an internal combustion engine and constructed in accordance to another example of the present disclosure includes a body having an outer peripheral surface configured for sliding movement in a bore provided in the engine. The bore is supplied by an oil passage communicating therewith. The body can define a transverse passage. A groove can be formed around the body and inset from the outer peripheral surface. A connecting channel can be formed in the body and inset from the outer peripheral surface, the connecting channel fluidly connects the groove and the transverse passage. A roller bearing can be rotatably mounted to the body and configured for rolling contact with an engine camshaft. Oil received at the groove from the bore flows along the connecting channel, into the transverse passage and onto the roller bearing.

According to other features, an anti-rotation ring can be received at the groove. The anti-rotation ring can be snap fit onto the groove of the body. The anti-rotation ring can include a ring body having an anti-rotation protrusion extending therefrom. The anti-rotation protrusion can be configured to create a line contact with an opposing surface of a bore slot defined in the engine bore. The second height can is defined at the ring body. The anti-rotation protrusion has a third height in the axial direction. The third height is greater than the second height.

In other features, the groove extends along a groove depth into the peripheral surface. The connecting channel can extend along a connecting channel depth into the peripheral surface. The groove depth can be greater than the connecting channel depth. The connecting channel can extend axially along the peripheral surface in a direction transverse to the transverse passage.

An engine roller lifter for use in a valve train of an internal combustion engine and constructed in accordance to additional features includes a body that extends along a longitudinal axis. The body has an outer peripheral surface configured for sliding movement in a bore provided in the engine. The bore is supplied by an oil passage communicating therewith. The body can define (i) an axial pocket that receives a plunger therein and (ii) a transverse passage. A groove can be formed in the body and inset from the outer peripheral surface. A connecting channel can be formed in the body along an axis generally parallel to the longitudinal axis of the body. The connecting channel can be inset from the outer peripheral surface. The connecting channel can fluidly connect the groove and the transverse passage. An anti-rotation ring can be received at the groove. The anti-rotation ring can have a ring body and an anti-rotation protrusion extending therefrom. The anti-rotation protrusion can extend radially beyond the outer peripheral surface of the body in an installed position. The anti-rotation protrusion can be configured to create a line contact with an opposing surface of a bore slot defined in the engine bore. A roller bearing can be rotatably mounted to the body and configured for rolling contact with an engine camshaft. Oil received at the groove from the bore can flow around the anti-rotation ring, along the connecting channel, into the transverse passage and onto the roller bearing.

According to other features, the groove can extend along a groove depth into the peripheral surface. The connecting channel can extend along a connecting channel depth into the peripheral surface. The groove depth can be greater than the connection channel depth. The transverse passage can extend entirely through the body. The groove can have a first height in an axial direction. The anti-rotation ring can have a second height at the ring body in the axial direction. The first height can be greater than the second height. The anti-rotation protrusion can have a third height in the axial direction. The third height can be greater than the second height.

BRIEF DESCRIPTION OF THE DRAWINGS

The present disclosure will become more fully understood from the detailed description and the accompanying drawings, wherein.

DETAILED DESCRIPTION

Figure 1:
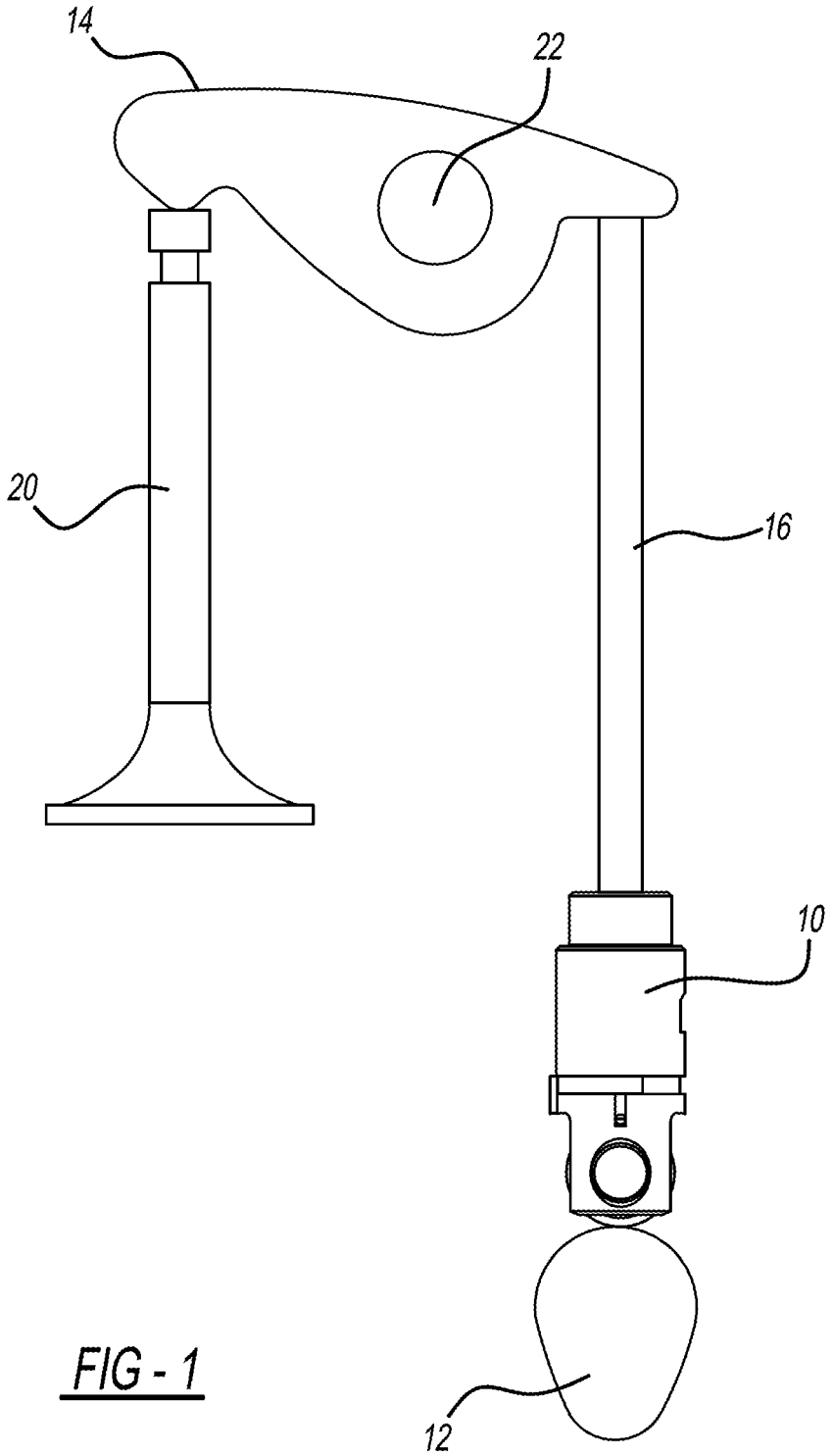
FIG. 1 is a roller lifter constructed in accordance to one example of the present disclosure and shown in an exemplary Type V valve train arrangement.

With initial reference to FIG. 1, a roller lifter constructed in accordance to one example of the present disclosure is shown and generally identified at reference number 10. The roller lifter 10 is shown as part of a Type V arrangement. It will be appreciated that while the roller lifter 10 is shown in a Type V arrangement, the roller lifter 10 may be used in other arrangements within the scope of the present disclosure. In this regard, the features described herein associated with the roller lifter 10 can be suitable to a wide variety of applications. A cam lobe 12 indirectly drives a first end of a rocker arm 14 with a push rod 16. It will be appreciated that in some configurations, such as an overhead cam, the roller lifter 10 may be a direct link between the cam lobe 12 and the rocker arm 14. A second end of the rocker arm 14 actuates a valve 20. As the cam lobe 12 rotates, the rocker arm 14 pivots about a fixed shaft 22.

Figure 4:
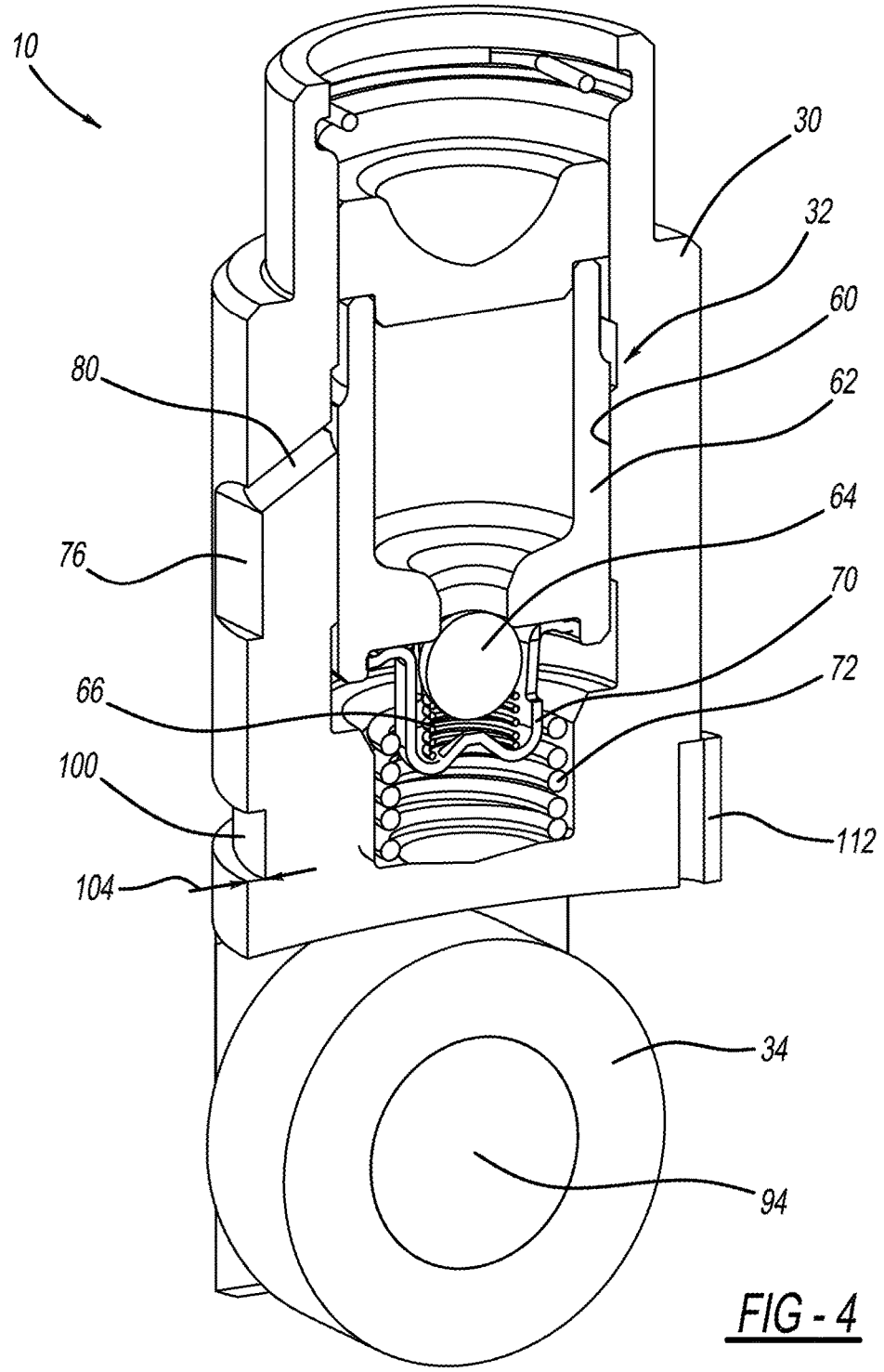
FIG. 4 is cross-sectional view of the roller lifter taken along lines 4-4 of FIG. 2.
Figure 5:
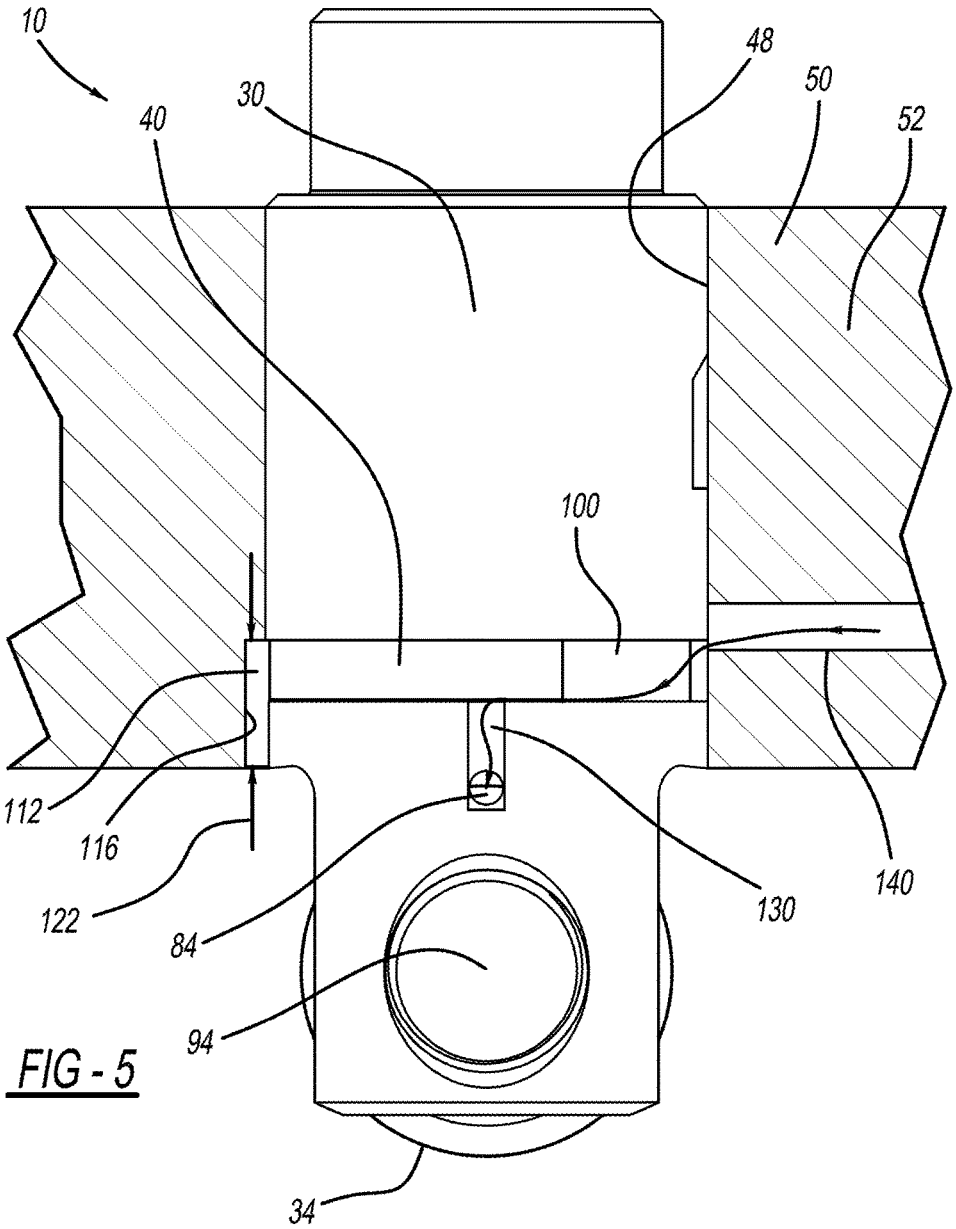
FIG. 5 is a side view of the roller lifter shown received in an exemplary guide bore of a cylinder head of an internal combustion engine illustrating details of an exemplary oil feed circuit.

With additional reference now to FIGS. 2-5, the roller lifter 10 will be described in greater detail. The roller lifter 10 generally includes a body 30, a leakdown assembly 32 received within the body 30, a roller bearing 34 rotatably mounted to the body 30 and an anti-rotation ring 40. The body 30 includes an outer peripheral surface 42 configured for sliding movement in a bore 48 provided in a cylinder head 50 of an internal combustion engine 52 (FIG. 5).

The body 30 can define an axial pocket 60 that receives the leakdown assembly 32. The leakdown assembly 32 can include a plunger 62, a check ball 64, a first biasing member 66, a cage 70 and a second biasing member 72. An inset 76 can be provided in the body 30 at the outer peripheral surface 42. An oil inlet hole 80 (FIG. 4) can be defined in the body 30 that connects the inset 76 with the axial pocket 60. The oil inlet hole 80 can be configured to communicate oil between the outer peripheral surface 42 and the plunger 62 of the leakdown assembly 32.

Figure 6:
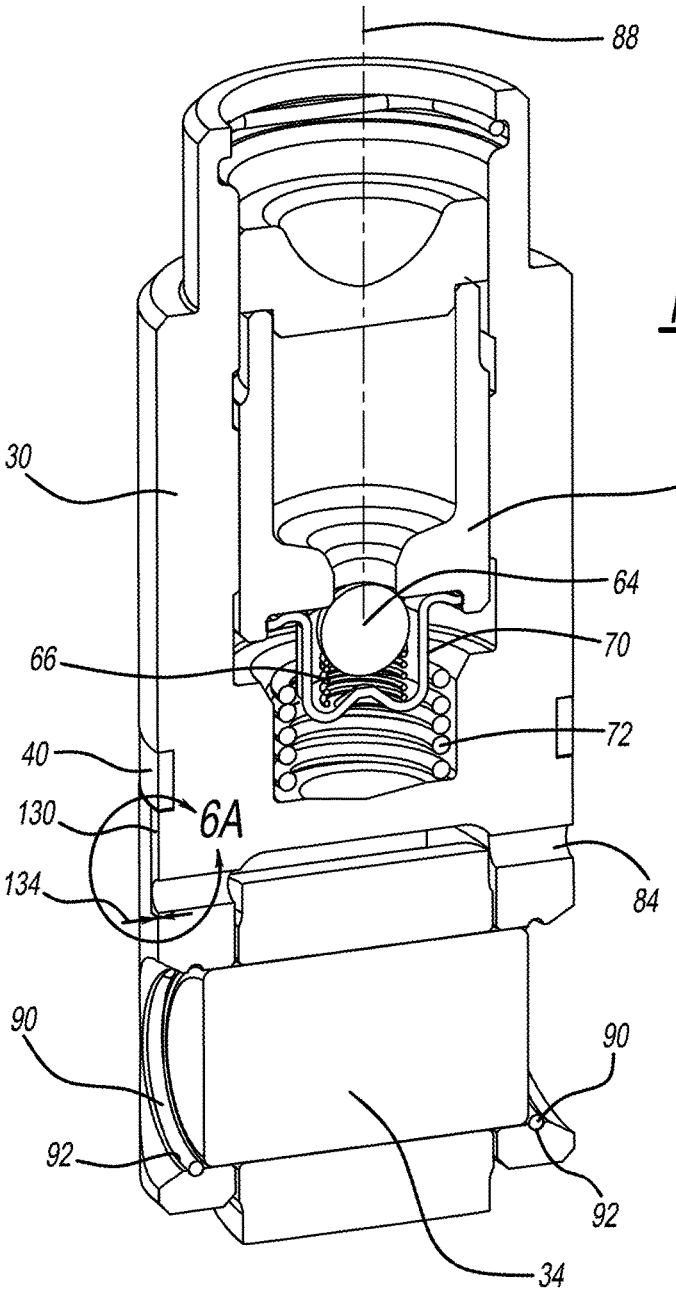
FIG. 6 is a cross-sectional view of the roller lifter taken along lines 6-6 of FIG. 2.

With continued reference to FIGS. 1-5 and additional reference to FIG. 6, additional features of the body 30 will be described. The body 30 can define a transverse passage 84. The transverse passage 84 can extend entirely through the body 30 along an axis generally transverse to a longitudinal axis 88 of the body 30. A pair of clips 90 are nestingly received in corresponding grooves 92 formed on the body 30 for capturing an axle 94 of the roller bearing 34 in the roller lifter 10. As identified above, the roller bearing 34 can be configured for rolling contact with the engine camshaft 12.

Figure 2:
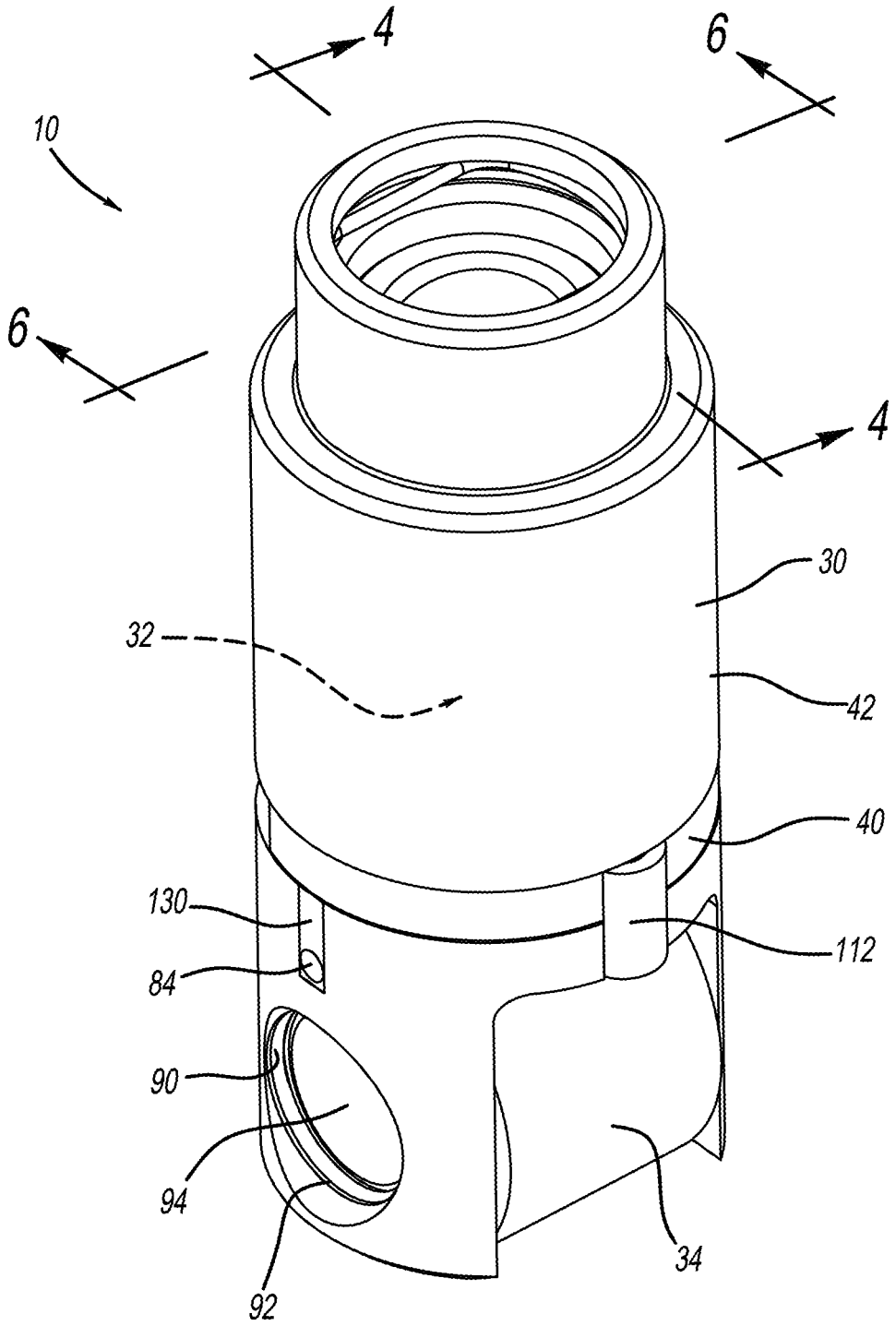
FIG. 2 is a first side perspective view of the roller lifter of FIG. 1.

The body 30 includes a groove 100 formed therein and inset from the outer peripheral surface 42. The groove 100 has a groove width 102 (FIG. 3) and a groove depth 104 (FIG. 4). The groove 100 is configured to receive the anti-rotation ring 40 thereat (FIGS. 2 and 3).

Figure 3:
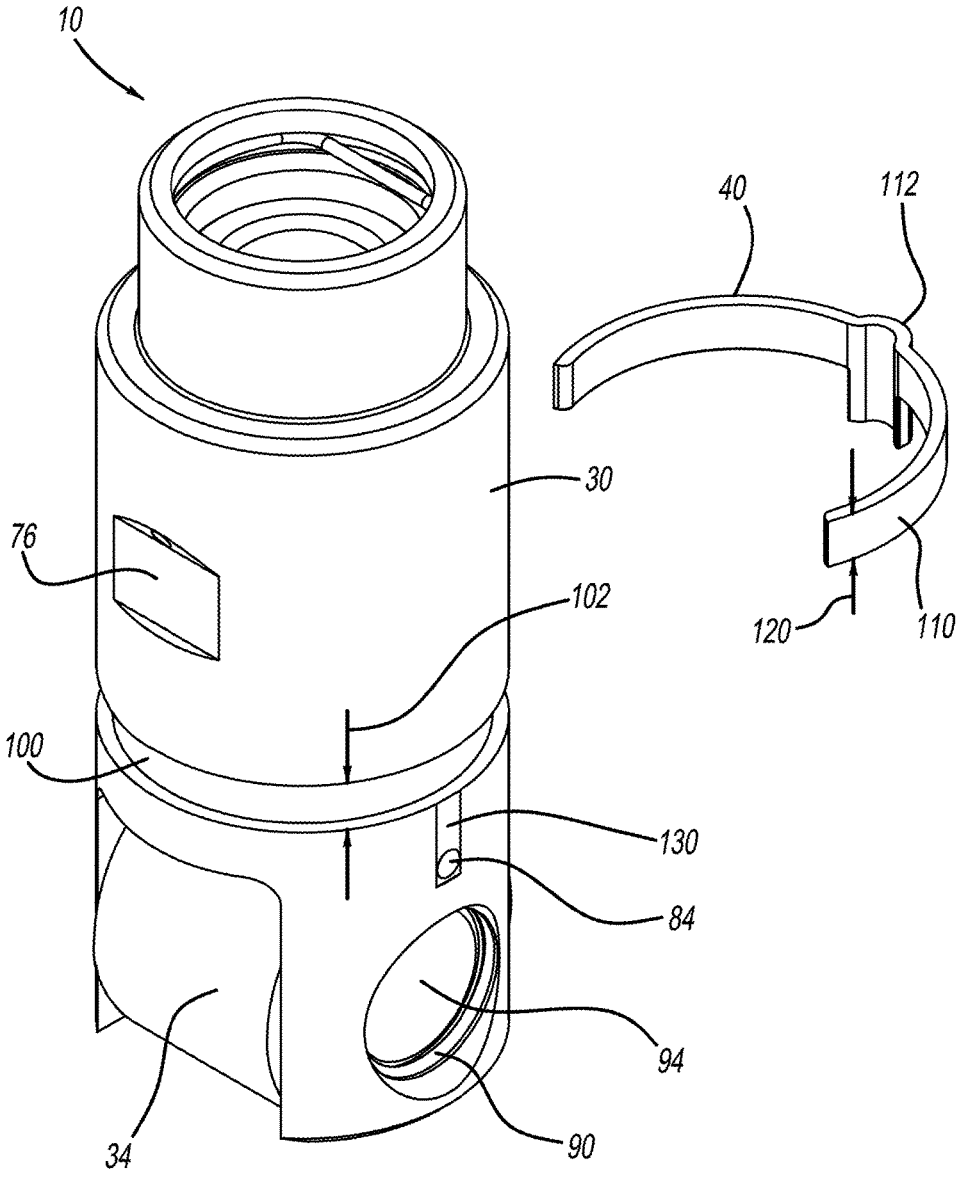
FIG. 3 is a second side perspective view of the roller lifter of FIG. 2 and shown with an anti-rotation clip in exploded view.
Figure 5A:
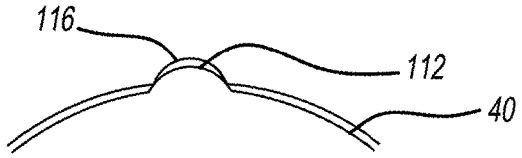
FIG. 5A is a detail view of an interface between an anti-rotation ring and an opposing bore slot in the cylinder head.

With particular reference to FIG. 3, the anti-rotation ring 40 will be further described. The anti-rotation ring 40 generally includes a ring body 110 having an anti-rotation protrusion 112 extending therefrom. The anti-rotation protrusion 112 extends radially beyond the outer peripheral surface 42 of the body 30 in an installed position. The anti-rotation protrusion 112 is configured to locate or key in a corresponding bore slot 116 in the cylinder head 50 for inhibiting rotation of the roller lifter 10 about the axis 88 during operation. The anti-rotation ring 40 can be snap fit into the groove 100. The anti-rotation ring 40 has a first height 120 (FIG. 3) at the ring body 110 and a second height 122 (FIG. 5) at the anti-rotation protrusion 112. In one example the second height 122 is greater than the first height 120. In one advantage, the snap fit relationship of the anti-rotation ring 40 and the groove 100 allows for far looser tolerances as compared to a conventional pin press-fit into a hole. In this regard, the configuration can be less costly and provide greater surface area contact (line contact along the second height 122 of the anti-rotation protrusion 112 with the surface of the bore slot 116) rather than a conventional point contact offered by a round headed pin with the cylinder head 50. See also FIG. 5A. The anti-rotation ring 40 reduces stress and thus wear on the bore slot 116 and the anti-rotation protrusion 112.

The body 30 includes a connecting channel 130 formed therein. The connecting channel 130 can be inset a connecting channel depth 134 from the outer peripheral surface 42. In one example the connecting channel depth 134 is less than the groove depth 104. The connecting channel 130 fluidly connects the groove 100 with the transverse passage 84.

Figure 6A:
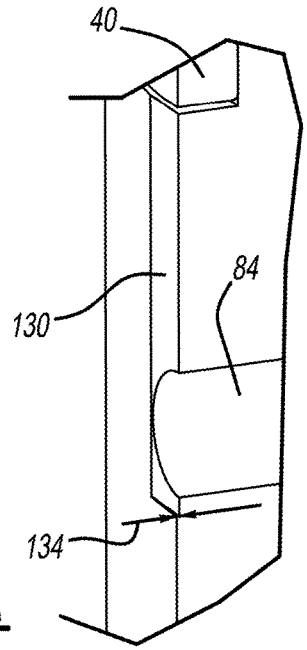
FIG. 6A is a detail view of area 6A of FIG. 6.

During operation, oil received at the groove 100 from an oil passage 140 (FIG. 5) defined in the cylinder head 50 of the engine 52 flows around the anti-rotation ring 40, along (down) the connecting channel 130, into the transverse passage 84 and onto the roller bearing 34. Explained further, oil is permitted to flow around the ring body 110 of the anti-rotation ring 40 within the groove 100. In one example, the ring height 120 is less than the groove width 102 allowing a predetermined rate of oil to pass between the ring body 110 and the body 30 of the roller lifter 10. The groove 100 is therefore dual-purpose allowing for receipt of the anti-rotation clip 40 and providing an oil pathway to communicate oil to the roller bearing 34. Furthermore, because the connecting channel 130 is inset or recessed into the outer peripheral surface 42 of the body, a predetermined amount of oil is permitted to flow from the groove 100 to the transverse passage 84. See also FIG. 6A. In the example shown, the connecting channel depth 134 is minimal so as to control the rate of oil flow to a predetermined value. In one configuration, the connecting channel 130 can extend along an axis that is parallel to the longitudinal axis 88.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An engine roller lifter for use in a valve train of an internal combustion engine, the engine roller lifter comprising:

a body having an outer peripheral surface configured for sliding movement in a bore provided in the engine, the bore supplied by an oil passage communicating therewith, the body defining (i) an axial pocket that receives a plunger therein and (ii) a transverse passage;

a groove formed in the body and inset from the outer peripheral surface;

a connecting channel formed in the body and inset from the outer peripheral surface, the connecting channel fluidly connecting the groove and the transverse passage;

an anti-rotation ring received at the groove; and a roller bearing rotatably mounted to the body and configured for rolling contact with an engine camshaft;

wherein oil received at the groove from the bore flows around the anti-rotation ring, along the connecting channel, into the transverse passage and onto the roller bearing.

2. The engine roller lifter of claim 1 wherein the groove has a first height in an axial direction and the anti-rotation ring has a second height in the axial direction, the first height being greater than the second height.

3. The engine roller lifter of claim 2 wherein the anti-rotation ring includes a ring body having an anti-rotation protrusion extending therefrom, wherein the second height is defined at the ring body and wherein the anti-rotation protrusion has a third height in the axial direction, the third height being greater than the second height, wherein the anti-rotation protrusion is configured to create a line contact with an opposing surface of a bore slot defined in the engine bore.

4. The engine roller lifter of claim 1 wherein the connecting channel is transverse to an axis of the transverse passage.

5. The engine roller lifter of claim 1 wherein the transverse passage extends entirely through the body.

6. The engine roller lifter of claim 1 wherein the body further defines an inset formed in the outer peripheral surface.

7. The engine roller lifter of claim 6, further comprising an oil inlet hole defined in the body that connects the inset with the axial pocket, the oil inlet hole configured to communicate oil between the outer peripheral surface and the plunger.

8. The engine roller lifter of claim 1 wherein the anti-rotation ring is snap fit onto the groove of the body.

9. The engine roller lifter of claim 1 wherein the groove extends along a groove depth into the outer peripheral surface and wherein the connecting channel extends along a connecting channel depth into the outer peripheral surface, wherein the groove depth is greater than the connection channel depth.

10. The engine roller lifter of claim 9 wherein the connecting channel extends axially along the outer peripheral surface in a direction transverse to the transverse passage.

11. An engine roller lifter for use in a valve train of an internal combustion engine, the engine roller lifter comprising:

a body having an outer peripheral surface configured for sliding movement in a bore provided in the engine, the bore supplied by an oil passage communicating therewith, the body defining a transverse passage;

a groove formed around the body and inset from the outer peripheral surface;

a connecting channel formed in the body and inset from the outer peripheral surface, the connecting channel fluidly connecting the groove and the transverse passage;

a roller bearing rotatably mounted to the body and configured for rolling contact with an engine camshaft;

an anti-rotation ring received at the groove, the anti-rotation ring having a protrusion that is configured to create a line contact with an opposing surface of a bore slot defined in the engine bore; and wherein oil received at the groove from the bore flows along the connecting channel, into the transverse passage and onto the roller bearing.

12. The engine roller lifter of claim 11 wherein the anti-rotation ring is snap fit onto the groove of the body.

13. The engine roller lifter of claim 12 wherein the anti-rotation ring includes a ring body having an anti-rotation protrusion extending therefrom, wherein the second height is defined at the ring body and wherein the anti-rotation protrusion has a third height in the axial direction, the third height being greater than the second height.

14. The engine roller lifter of claim 11 wherein the groove extends along a groove depth into the outer peripheral surface and wherein the connecting channel extends along a connecting channel depth into the outer peripheral surface, wherein the groove depth is greater than the connection channel depth.

15. The engine roller lifter of claim 14 wherein the connecting channel extends axially along the outer peripheral surface in a direction transverse to the transverse passage.

16. An engine roller lifter for use in a valve train of an internal combustion engine, the engine roller lifter comprising:

a body that extends along a longitudinal axis, the body having an outer peripheral surface configured for sliding movement in a bore provided in the engine, the bore supplied by an oil passage communicating therewith, the body defining (i) an axial pocket that receives a plunger therein and (ii) a transverse passage;

a groove formed in the body and inset from the outer peripheral surface;

a connecting channel formed in the body along an axis generally parallel to the longitudinal axis of the body, the connecting channel inset from the outer peripheral surface, the connecting channel fluidly connecting the groove and the transverse passage;

an anti-rotation ring received at the groove, the anti-rotation ring having a ring body and an anti-rotation protrusion extending therefrom, wherein the anti-rotation protrusion extends radially beyond the outer peripheral surface of the body in an installed position and is configured to create a line contact with an opposing surface of a bore slot defined in the engine bore; and a roller bearing rotatably mounted to the body and configured for rolling contact with an engine camshaft;

wherein oil received at the groove from the bore flows around the anti-rotation ring, along the connecting channel, into the transverse passage and onto the roller bearing.

17. The engine roller lifter of claim 16 wherein the groove extends along a groove depth into the outer peripheral surface and wherein the connecting channel extends along a connecting channel depth into the outer peripheral surface, wherein the groove depth is greater than the connection channel depth.

18. The engine roller lifter of claim 16 wherein the transverse passage extends entirely through the body.

19. The engine roller lifter of claim 16 wherein the groove has a first height in an axial direction and the anti-rotation ring has a second height at the ring body in the axial direction, the first height being greater than the second height, and wherein the anti-rotation protrusion has a third height in the axial direction, the third height being greater than the second height.

* * * * *